United States Patent [19]

Miller

[11] Patent Number: 4,839,630

[45] Date of Patent: Jun. 13, 1989

[54] EMERGENCY SIGNAL DEVICE

[76] Inventor: Robert A. Miller, 538 Palmer Blvd., North Fort Myers, Fla. 33903

[21] Appl. No.: 177,115

[22] Filed: Apr. 4, 1988

[51] Int. Cl.[4] ..... G08B 13/00

[52] U.S. Cl. ..... 340/574; 307/66; 340/326; 340/331; 340/693; 379/40

[58] Field of Search ..... 340/574, 538, 693, 326, 340/331; 379/40; 362/20, 183; 315/86; 307/66; 439/226

[56] References Cited

U.S. PATENT DOCUMENTS

| | | | |
|---|---|---|---|
| 3,886,534 | 5/1975 | Rosen et al. | 340/574 X |
| 3,925,763 | 12/1975 | Wadhwani et al. | 340/538 X |
| 4,189,721 | 2/1980 | Doell | 340/574 X |
| 4,212,003 | 7/1980 | Mishoe et al. | 340/574 |
| 4,518,946 | 5/1985 | Solomon | 340/326 |
| 4,535,391 | 8/1985 | Hsiao | 362/183 |
| 4,686,505 | 8/1987 | Vanderburg | 340/331 |

*Primary Examiner*—Glen R. Swann III
*Assistant Examiner*—Thomas J. Mullen Jr.
*Attorney, Agent, or Firm*—Polster, Polster and Lucchesi

[57] ABSTRACT

In a mobile home park having a source of a.c. house current, an emergency signal system for individual mobile homes includes a master unit including a step-down transformer electrically connected to the house current, an alarm circuit electrically connected to the transformer and including a high intensity flashing alarm lamp and an electrically operated horn, and a switch mounted on a box housing the transformer and much of the circuitry, the box being portable and positioned for easy accessibility. Lamps, mounted on the box, are provided to indicate that the transformer is receiving current, to illuminate the switch, and to indicate when the alarm has been activated. The flashing alarm lamp and horn are mounted on the outside of the mobile home. A second switch, hard wired into the alarm circuit, is mounted on the end of a long extension cord, whereby the alarm can be actuated from a place remote from the box as well as at the box. The box and interior circuitry permit the plugging in of a battery pack to energize the device in the event of failure of the house current, and a jack for receiving a connector for actuating a telephone dialer.

5 Claims, 2 Drawing Sheets

EMERGENCY SIGNAL DEVICE

BACKGROUND OF THE INVENTION

The device of this invention has particular application to mobile home parts in retirement areas, and, although its utility is not limited thereto, it will be described as applied to that environment.

Many thousands of retired people live in so-called mobile homes in mobile home parks. The term is no longer apt, because most of the homes are not at all mobile, and are substantial and comfortable for permanent living quarters. They may better be called manufactured type homes, and the term "mobile homes" as used herein embraces all such structures. As they get older, the chances that the people who live in these parks will have an accident in their homes, or suffer a heart attack or stroke or other sudden illness that requires immediate attention increases markedly. It is important that the victim of such an event be helped quickly. However, even with the availability of the 911 emergency telephone, long delays are occasioned by the fact that the homes in the trailer park tend to look alike, and they are often not well marked. Alarm systems have been proposed, and some are in use. For most part, these involve the use of miniature radio transmitters, which actuate a dialing system, and some of the systems involve the use of a flashing light or a horn, or both. Vanderburg, U.S. Pat. No. 4,686,505 discloses the use of a strobe light in a housing mounted on the outside of a building. A switch 40 is mounted on the housing, to be thrown in case of emergency. Solomon, U.S. Pat. No. 4,518,946 discloses an audio-visual alarm device. Systems of the radio transmitter type have the problems of radio interference, which may lead to false alarms, and a lack of a positive indication that the alarm or telephone dialing is in operation. A problem with devices in which a switch is mounted on the housing on the outside of the building is that one must be in a position to go outside to throw the switch.

One of the objects of this invention is to provide an alarm system that is economical to manufacture and affordable, that is simple and dependable, that can be activated from any place in the house, and at the same time is not subject to interference, and that gives a positive indication that it is working.

Other objects will become apparent to those skilled in the art in the light of the following description and accompanying drawing.

SUMMARY OF THE INVENTION

In accordance with this invention, generally stated, in a mobile home park having a source of A.C. house current, an emergency signal system for individual mobile homes is provided which includes a box having top, bottom and side walls; a step-down transformer in the box, the transformer having a primary and secondary winding; electrical connections between the primary winding of the transformer and the source of house current to energize the primary winding; a lamp electrically connected to be energized when the primary winding is energized to provide a constant indication that the house current power is on and to illustrate a master switch to permit its location to be readily determined. The master switch, of the maintained action type, is mounted in or on the top wall of the box with an operator projecting above the top wall of the box. An alarm circuit comprises the master switch, which is a manually operated, normally open switch, electrically connected to one side of a full wave rectified connected to one side of the secondary winding or to a battery pack and to a high intensity alarm lamp, with an auto flasher in series with it to cause it to flash, and an electrically operated, high decibel piezoelectric horn, electrically connected to one side of the switch and to the other side of the rectifier or battery pack, as the case may be, so as to be energized when the switch is closed, the lamp and horn being supported by a base mounted on an outside wall of the mobile home. An LED is electrically connected in parallel with the switch, to illuminate the switch operator and to indicate that power, either from the house current or from the battery pack is being supplied to the circuit. An alarm indicator lamp is mounted in the top surface of the box and electrically connected in series with the switch, beyond the auto flasher, so as to indicate, by flashing at the box, that the external alarm is operating. In the preferred embodiment, the alarm indicator lamp is electrically connected in parallel with the alarm lamp and horn, but draws insufficient current to permit the flasher to operate, thus being dependent upon the operation of the alarm lamp and horn for its operation. An extension cord receptacle is mounted in the wall of the box with two conductors electrically connected around the switch. An extension cord has two wires electrically connected to the two conductors of the receptacle at one end of the extenion cord and to a normally open, manually operated maintained-action extension cord switch at the other, outer end of the extension cord. A housing, physically mounted on the outer end of the extension cord, carries the switch, which has an operator part projecting outside of the housing to be easily accessible for manual operation and an LED, electrically connected in parallel with the switch so as to be energized constantly when the switch is open, and to be effectively deenergized when the switch is closed, to indicate that the alarm circuit has been completed. The LED serves to illuminate the switch operator part. The alarm circuit includes a relay electrically connected between the extension switch and the alarm lamp and horn, the relay being energized to close the circuit when the extension switch is closed and remaining energized until the switch is again opened by the depression of the operator. In the preferred embodiment, the system includes an electrical receptacle mounted in a wall of the box to receive a back-up battery power pack, the receptacle being electrically connected to the alarm circuit, and a normally open relay switch, biased to close when the transformer primary is not energized, for switching in the battery pack if the a.c. house current fails. It also includes a dialer jack socket mounted in the wall of the box and electrically connected to the alarm circuit and also electrically connected to a jack connected to an automatic telephone dialer.

DESCRIPTION OF THE PREFERRED EMBODIMENT

Figure 1:
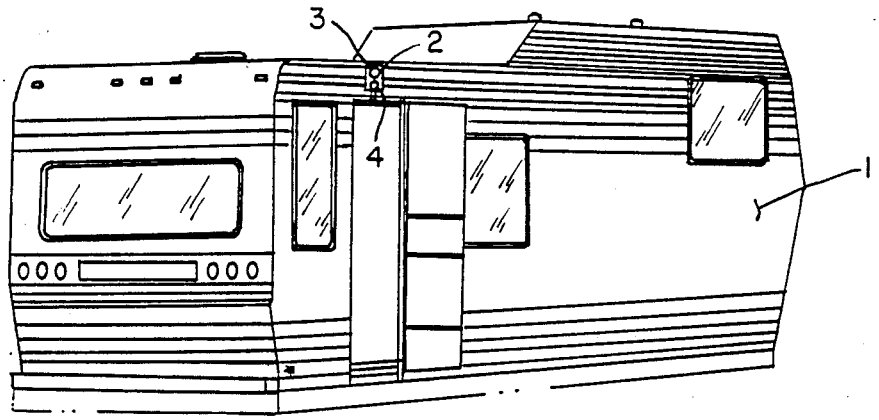
FIG. 1 is a view in perspective of a mobile home equipped with one embodiment of alarm system of this invention.

Referring now to the drawing for one illustrative embodiment of alarm system of this invention, reference numeral 1 indicates a mobile home on a side wall of which an external alarm 2 of one embodiment of this invention is mounted. In this illustrative embodiment, the external alarm 2 includes a bright alarm light 3 and a piezoelectric, high decibel horn 4. Reference numeral 5 indicates an alarm system package, which in this embodiment, includes a master unit box 6, from which a power cord 7 extends. The power cord 7 has a male connector 8 at its outer end, for connection to a source of alternating house current, usually 120 volts. The box 6 is rectangular, and has a top 96, an imperforate bottom, not here shown, side walls 97, and end walls, only one of which, end wall 98, is shown.

An external alarm receptacle 10 is mounted near the center of the end wall 98. An extension cord receptacle or jack socket 12, a dialer receptacle or jack socket 14, and battery pack receptacles 16 are also mounted in the end wall 98.

A primary power light or lamp 18 is incorporated in a master switch 68, which, along with an alarm indicator light or lamp 20, a constant power light or lamp 80, and a switch actuator 22 are all mounted in the top 96 of the box.

The box houses the elements of an operating circuit 25. The circuit 25 includes power leads 27 and 28, electrically connected to conductors in the power cord 7 and to two ends of a primary winding 33 of a step-down transformer 31. The connection of one end of the primary winding to the lead 28 is by way of a fuse 29. A secondary winding 37 of the transformer 31 is connected at both ends to terminals of a full wave rectifier 39, which has a plus side connection 40 and a minus side connection 41. A minus side electrical conductor 42 is connected to a battery relay switch contact 45 of a battery circuit relay 46. The battery circuit relay 46 has a coil 47 connected at its two ends to the leads 28 and 27, so that the relay coil is energized whenever the house current power is on. A relay armature contact 49 is spring biased in a direction away from the battery relay switch contact 45 and into engagement with a battery contact 51, but is pulled, against the bias of the spring, into contact with the contact 45 and out of contact with the contact 51 when the relay 46 is energized. The battery contact 51 is electrically connected to a battery receptacle contact 53. A positive battery receptacle contact 54 is electrically connected by way of conductor 44 to a positive electrical conductor 43, electrically connected to the plus side connection 40 of the full wave rectifier 39. The armature contact 49 is electrically connected by a conductor 60 to a minus external alarm terminal 55, by way of an auto flasher 56, and to one end of a coil 57 of a second relay 59, the other end of which is connected to a minus terminal 63 of the extension cord receptacle 12. A positive extension cord outlet terminal 64 is electrically connected to the conductor 43.

In the embodiment shown, the conductor 43 is connected by way of two, alternate, normally open switches to a positive side terminal 65 of the external alarm receptacle 10. One of the two alternate switch circuits by which the conductor 43 is electrically connected to the terminal 65 is by way of a switch blade 67 of the master switch 68, which, in the embodiment shown, is a double pole, single throw switch of the manual, maintained-action type. The blade 67 is hingedly mounted at one end on a terminal 76, and movable to engage a contact 66. The constant power lamp 80, in this embodiment a light emitting diode, is electrically connected, in parallel with the switch blade 67, between the terminal 76 and the contact 66. The blade 77 and, in the illustrative embodiment shown, a switch blade 69, are operated by the operator part 22 that projects from the top of the box.

The second blade 69 of the switch 68 completes a circuit of the dialer receptacle 14, by shorting terminals 104 and 105 when the operator 22 is depressed.

Figure 2:
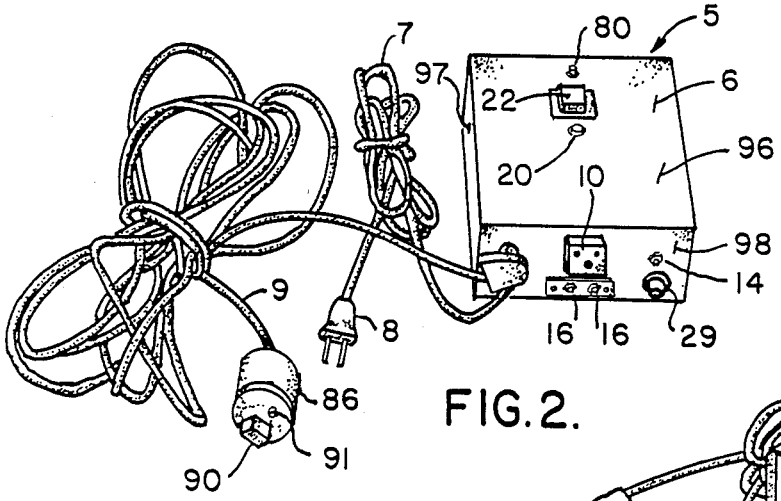
FIG. 2 is a view in perspective of a control box, power cord and extension cord of the system of this invention.
Figure 3:
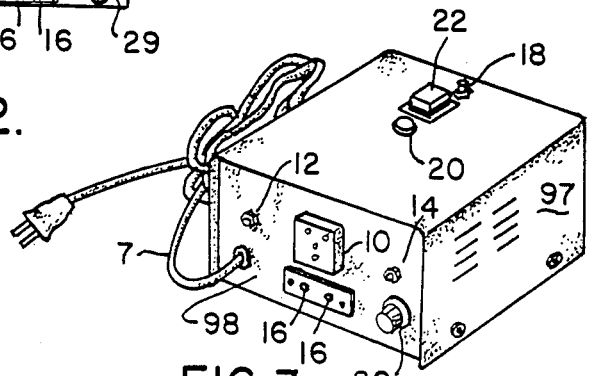
FIG. 3 is a view in perspective from a different angle of the box of FIG. 2, with the extension cord removed.
Figure 4:
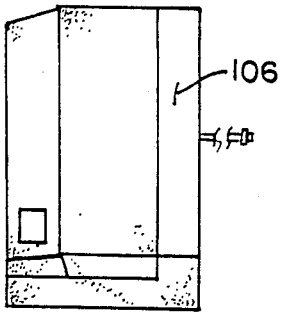
FIG. 4 is a top plan view of a telephone dialer adapted to be used in the system of this invention.
Figure 5:
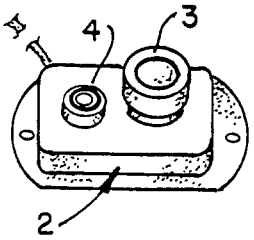
FIG. 5 is a view in perspective of one form of external alarm of this invention.
Figure 6:
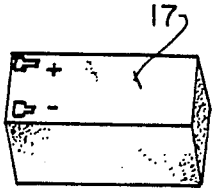
FIG. 6 is a battery pack for use with one embodiment of this invention.
Figures 7, 8, 9:
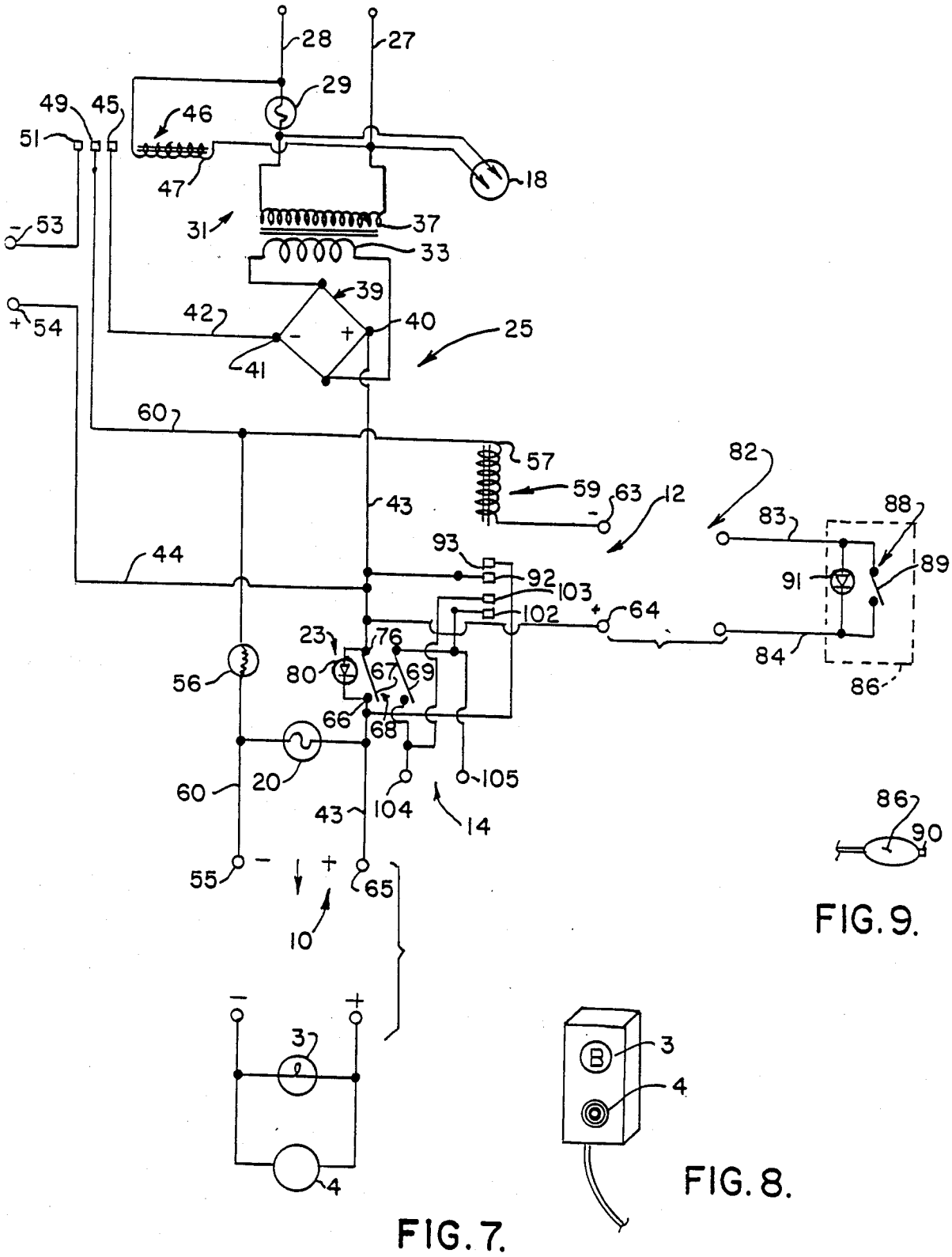
FIG. 7 is a circuit diagram of one embodiment of alarm system of this invention.
FIG. 8 is another embodiment of external alarm.
FIG. 9 is a view in side elevation of another embodiment of extension cord switch housing.

Two electrical conductors, a negative conductor 83, and a positive conductor 84 of an extension cord 9 are electrically connected to the terminals 63 and 64 respectively. The conductors 83 and 84 are connected electrically, by a single pole switch 88, with an arm 89 mechanically connected to an actuator 90, and by an LED 91, connected in parallel with and around a switch 88, which, in this embodiment is also a manual, maintained-action switch, in which depressing the switch operator completes the circuit which remains completed until the operator is again depressed. The switch 88 and LED 91 are housed in a housing 86, of which two forms are shown, in FIGS. 2 and 9 respectively.

The relay 59 and the extension switch 88 are part of an extension switch circuit 82, which includes a second relay armature contact 92 and a bypass contact 93, and a dialer armature contact 102 and a dialer contact 103. The armature contact 92 is normally biased away from the bypass contact 93, but is pulled into contact with the contact 93 when the coil 57 of the second relay 59 is energized by closing of the switch 88. The armature contact 102 is normally biased away from the dialer contact 103, but is pulled into contact with the contact 103 when the coil 57 is energized. When the switch 88 is closed, current of negative polarity flows through the contact 49, either from the rectifier 39 or from the battery 53, through the coil 57, through the switch and line 84 to the positive conductor 43, completing the circuit and energizing the relay. The relay pulls in the contact 92, completing the circuit from the positive terminal 40 of the rectifier or positive terminal 54 of the battery, through conductor 43 and contacts 92 and 93, back to the line 43 around the open switch 68, to the terminal 65, hence to the flashing light 3 and horn 4, which are always electrically connected to the contact 49.

Accordingly, the alarm can be sounded either by closing the switch 68 or the switch 88 to actuate the alarm. Because in the embodiment shown, the switch 68 is a double pole switch, the switch blade 69 closes to complete a phone dialing circuit by shorting terminals 104 and 105. If a phone dialer 106 is electrically connected by means of a conductor 107 to the dialer receptacle 14, when the terminals 104 and 105 are connected to short them out, the dialer, which acts in response to the shorting of the terminals, will act to dial up to three different telephone numbers.

If a battery back-up is desired, a battery pack 17 can be electrically connected to the battery pack receptacle 16, in which case, if the house current fails, the relay 46 will be de-energized, permitting the relay contact 49 to engage the battery contact 51 to supply the necessary current.

The provision of an extension cord and switch is an important feature. A cord forty feet long will generally reach all of the areas of a mobile home in which a person is likely to be. By keeping the housing 86 in a convenient, easily reached place, as by the side of the bed, or even on the floor of a working area, a person can ensure that if he falls or suffers a heart attack, he will be able to summon help. Because the circuitry is all hard wired, there is no danger of radio frequency interference, and because the switches are all manually operated, there is little or no danger or an alarm's being triggered unintentionally. Because the master switch and the extension both are connected to low voltage, generally 12 volts. there is no real danger of electrocuting the user, even if the user were standing on a damp surface, or standing or sitting in water. The device also indicates at a glance whether the house current is on, and, if not, by virtue of the LEDS whether the battery is operating. The LEDs and the neon primary power light 18 make it easy to locate a switch, and the alarm indicator light 20 gives immediate indication that the alarm system is in operation.

Numerous variations in the construction of the device of this invention, within the scope of the appended claims, will occur to those skilled in the art in the light of the foregoing disclosure. Merely by way of example, and not of limitation, a plurality of extension cords can be electrically connected to the receptacle 12, so that the housings can be left in permanent locations in various parts of the home, or jacks or wall sockets, permanently wired to the master circuit, can be installed, into which a short cord can be plugged. The external alarm can take different forms, as can the extension housing, in addition to the two embodiments shown. Different lamps can be used instead of the LEDs. Other audible signal devices, such as sirens or buzzers can be used, and all are encompassed within the term "horn" as used herein. By reversing the positions of the lamp and horn shown in FIG. 7, and putting the flasher 56 between the horn and the lamp, the horn can be operated continuously while the lamp flashes. These are merely illutrative.

Having thus described the invention, what is claimed and desired to be secured by Letters Patent is:

1. In a mobile home park having a source of a.c. house current, an emergency signal system for individual mobile homes comprising a box having top, bottom and side walls; a step-down transformer in said box, said transformer having a primary and a secondary winding, each with two sides; electrical connections between said primary winding of said transformer and said source of house current to energize said primary winding; a primary power lamp electrically connected between said two sides of said primary winding to be energized when said primary winding is energized to provide a constant indication that the house current power is on and to illuminate the said box to permit its location to be readily determined; an alarm circuit electrically connected to said secondary winding, said alarm circuit comprising a manually operated, maintained-action switch mounted in said box with a switch operating part projecting outwardly from said top wall of said box, electrically connected to one side of said secondary winding; a high intensity flashing alarm lamp and an electrically operated horn electrically connected to one side of said switch and to the other side of said secondary winding so as to be energized when said switch is closed; a base supporting said flashing lamp and horn, mounted on an outside wall of said mobile home; an alarm indicator lamp mounted in said top wall of said box and electrically connected with said lamp and horn, whereby said second lamp is energized when said alarm lamp and horn are energized; an extension cord receptacle mounted in a wall of said box and electrically connected across said switch; an extension cord with a plurality of wires electrically connected to said receptacle at one end of said extension cord and to a normally open, manually operated extension cord switch at the other, outer end of said extension cord; a housing physically mounted on said outer end of said extension cord, said extension cord switch being mounted in said housing and having an operator part projecting outside thereof to be easily accessible for manual operation, and an extension lamp, mounted in said housing, electrically connected in parallel with said switch to two wires of said extension cord.

2. The system of claim 1 wherein a constant power lamp is connected in parallel across said master switch, and said power lamp and said extension lamp are LEDs.

3. The system of claim 1 wherein said switch is a manual maintained-action switch, whereby said alarm lamp and horn remain energized when the switch is closed until it is manually opened or the power is interrupted.

4. The system of claim 1 including an electrical receptacle mounted in a wall of said box to receive a back-up battery power pack, said receptacle being electrically connected to said alarm circuit, and a.c. power failure circuit means for switching in said battery power pack when said a.c. house current fails.

5. The system of claim 1 including an electric jack socket mounted in the wall of said box and electrically connected to said alarm circuit and electrically connected to a jack electrically connected to an automatic telephone dialer.

* * * * *

UNITED STATES PATENT AND TRADEMARK OFFICE

CERTIFICATE OF CORRECTION

PATENT NO. : 4,839,630
DATED : June 13, 1989
INVENTOR(S) : Robert A. Miller

It is certified that error appears in the above-identified patent and that said Letters Patent is hereby corrected as shown below:

Column 1, line 25, after "For" insert --- the ---
Column 1, line 63, delete "illustrate" and insert --- illuminate ---
Column 2, line 2, delete "rectified" and insert --- rectifier ---
Column 2, line 30, delete "extenion" and insert --- extension ---
Column 5, line 49, delete "illutrative" and insert --- illustrative ---

Signed and Sealed this

Twentieth Day of February, 1990

*Attest:*

JEFFREY M. SAMUELS

*Attesting Officer*

*Acting Commissioner of Patents and Trademarks*